US006680605B2

(12) United States Patent
Chen et al.

(10) Patent No.: US 6,680,605 B2
(45) Date of Patent: Jan. 20, 2004

(54) SINGLE-SEED WIDE-SWING CURRENT MIRROR

(75) Inventors: Shin-Chung Chen, Los Gatos, CA (US); Timothy Tehmin Lu, Campbell, CA (US)

(73) Assignee: Exar Corporation, Fremont, CA (US)

( * ) Notice: Subject to any disclaimer, the term of this patent is extended or adjusted under 35 U.S.C. 154(b) by 0 days.

(21) Appl. No.: 10/141,636

(22) Filed: May 6, 2002

(65) Prior Publication Data

US 2003/0205994 A1 Nov. 6, 2003

(51) Int. Cl.[7] ..... G05F 3/16
(52) U.S. Cl. ..... 323/315
(58) Field of Search ..... 323/313, 314, 323/315; 327/539, 540, 541

(56) References Cited

U.S. PATENT DOCUMENTS 4,471,292 A * 9/1984 Schenck et al. ..... 323/315
4,550,284 A * 10/1985 Sooch ..... 323/315
5,966,005 A * 10/1999 Fujimori ..... 323/315

* cited by examiner

*Primary Examiner*—Shawn Riley
(74) *Attorney, Agent, or Firm*—Townsend and Townsend and Crew LLP

(57) ABSTRACT

A current mirror circuit that uses only a single seed current, and thus only a single current source. A transistor biasing circuit is connected in between the single current source and the two transistors of the first leg of the current mirror. The transistor biasing circuit provides two functions. First, the source current itself flows through the transistors of the transistor biasing circuit to the two transistors forming the first leg of the current mirror. Second, the transistor biasing circuit biases the gates of the transistors in the current mirror so that the output transistors are at the onset of saturation.

5 Claims, 3 Drawing Sheets

Conventional Wide-Swing Current Mirror with NFET transistors

Conventional Wide-Swing Current Mirror with PFET transistors

SINGLE-SEED WIDE-SWING CURRENT MIRROR

BACKGROUND OF THE INVENTION

The present invention relates to current mirror circuits. FIG. 1 shows a conventional wide-swing current mirror circuit as used in analog IC design using CMOS transistors. A pair of series connected transistors and form one leg of the current mirror. The other leg is formed by transistors 14 and 16 which are also in series and have their gates connected to transistors 10 and 12, respectively. The current I flowing through transistors 14 and 16 will be mirrored by the current flowing through transistors 10 and 12. A first seed current from a current source 18 is provided through a diode-connected transistor 20 to establish a bias voltage for transistor 14. A second seed current from a second current source 22 feeds through a diode-connected transistor pair 14 and 16 to create a gate-source voltage for transistor 16. The transistor sizes are designed in such a way that the source of transistor 14 is at a voltage just enough to bias the drain of transistor 16 (node 24) at the knee of saturation without going into the triode region. Transistors 10 and 12 have corresponding transistor sizes to transistors 14 and 16, respectively. Thus, they produce a mirrored output current $I_0$.

FIG. 2 shows a similar circuit to FIG. 1, but implemented with PFET transistors, rather than the NFET transistors of FIG. 1.

The designs of FIGS. 1 and 2 have the disadvantage of requiring two different current sources, which can become problematic if a significant number of current mirrors need to be implemented on a semiconductor chip. The extra current sources consume not only chip space, but also power.

BRIEF SUMMARY OF THE INVENTION

The present invention provides a current mirror circuit that uses only a single seed current, and thus only a single current'source. A transistor biasing circuit is connected in between the single current source and the two transistors of the first leg of the current mirror. The transistor biasing circuit provides two functions. First, the seed current itself flows through the transistors of the transistor biasing circuit to the two transistors forming the first leg of the current mirror. Second, the transistor biasing circuit biases the gates of the transistors in the current mirror so that the output transistors are at the beginning of saturation.

In one embodiment, two transistors are used for the biasing circuit. One is connected between the current source and the gates of the first pair of current mirror transistors. The other is connected: between the gates of the first pair of current mirror transistors and the gates of the second pair of current mirror transistors. The two biasing transistors are sized so that they form a ratio which will maintain the desired biasing point over variations in the seed current.

For further understanding of the nature and advantages of the invention, reference should be made to the following description taken in conjunction with the accompanying drawings.

DETAILED DESCRIPTION OF THE INVENTION

The present invention uses only one seed current. Since two seed currents are required in the conventional wide-swing current mirror circuits, extra circuitry and power is required. This is particularly true in-certain applications where seed current is generated in a more complex way, and therefore, an extra seed current may not be readily available without going through at least a couple of more PFET and NFET current mirrors. The extra mirroring of currents will produce more variations in the resulting output currents. In these cases the present invention becomes very convenient and desirable, because it is largely insensitive to variations in the seed current. In addition, since only a single seed current is needed for the current mirror, the present invention will greatly simplify circuit complexities and has power and silicon area advantages.

Figure 1:
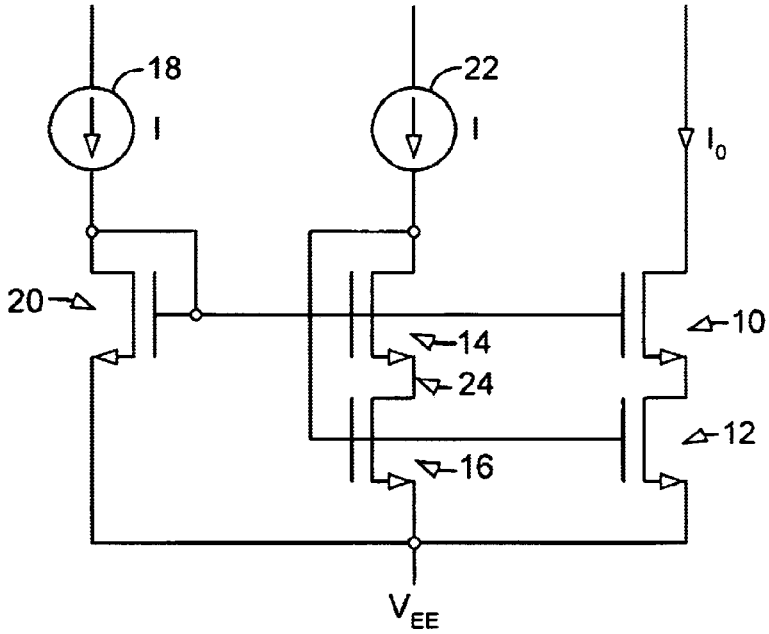
FIG. 1 is a circuit diagram of a prior art wide-swing current mirror with NFET transistors.
Figure 2:
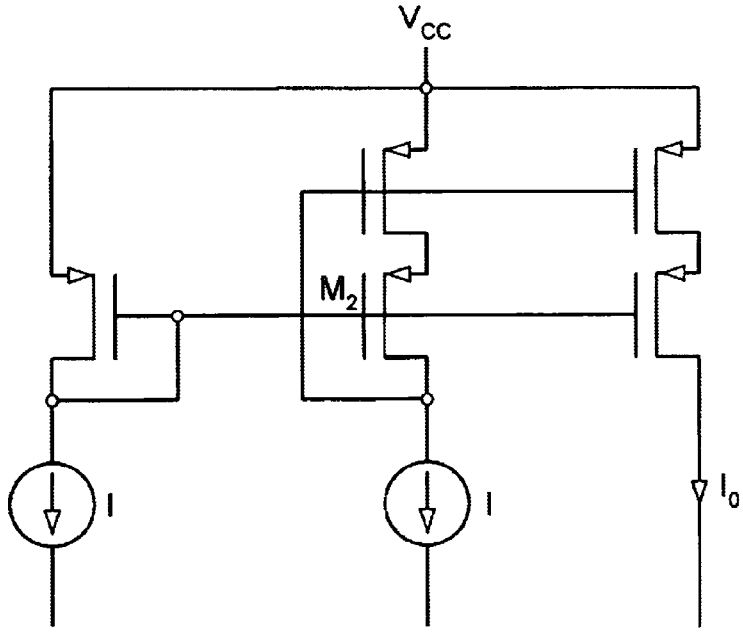
FIG. 2 is a circuit diagram of a prior art wide-swing current mirror with PFET transistors.
Figure 3:
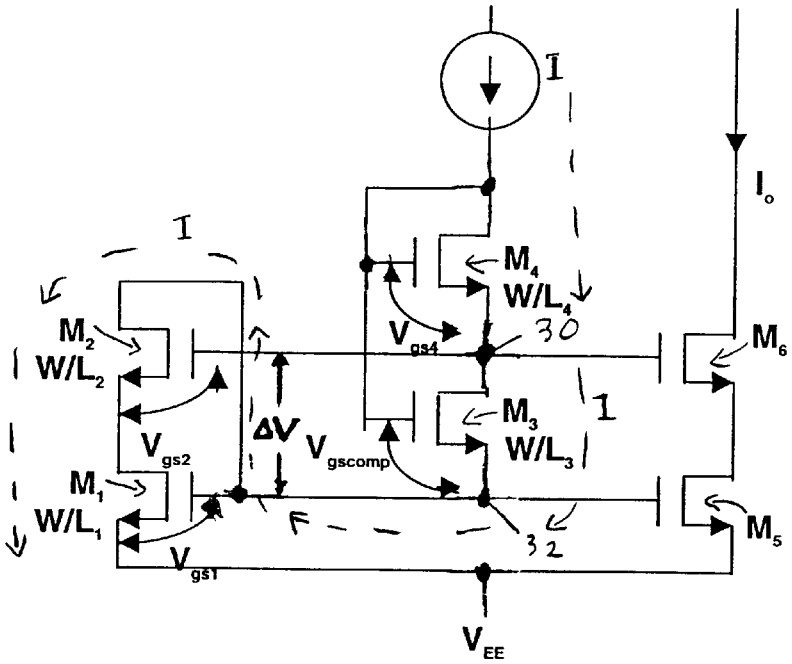
FIG. 3 is a circuit diagram of one embodiment of the present invention using NFET transistors.

FIG. 3 shows the first embodiment of the present invention using NFET transistors. One leg of the current mirror is provided by transistors $M_2$ and $M_1$, while the other leg is provided by transistors $M_6$ and $M_5$. Biasing transistors $M_4$ and $M_3$ bias the connected gates of transistors $M_2$ and $M_6$, and also of $M_1$ and $M_5$. In addition, transistors $M_4$ and $M_3$ conduct a current I through the transistors, with the same current then passing through transistors $M_2$ and $M_1$, as illustrated by the dotted line. This is the current that is mirrored as current $I_0$ provided through $M_6$ *and M5*.

Transistors $M_1$, $M_2$, $M_3$, and $M_4$ establish the bias for the current mirror transistors $M_5$ and $M_6$. The seed current I is fed into the drain of transistor $M_4$ and subsequently passes through transistors $M_3$, $M_2$ and $M_1$ to VEE. Transistors $M_3$ and $M_4$, of sizes $W/L_3$ and $W/L_4$, respectively, form a composite transistor $M_{comp}$ of size $W/L_{comp}$ (where $L_{comp}=L_3+L_4$). By the way the transistors $M_{comp}$ and $M_4$ are connected, they are operating in saturation. The purpose of transistors $M_3$ and $M_4$ is to bias the drain of $M_1$ at the knee of saturation. The following explains how this is accomplished.

For transistor $M_1$ in saturation, we have $$V_{gs1}-V_{T1}\leqq V_{ds1}=V_{gs1}+\Delta V-V_{gs2}$$

$$\Delta V\geqq V_{gs2}=V_{T1} \tag{1}$$

Now $V_{T2}=V_{T1}+\gamma(\sqrt{2\Phi_{F+Vds1}}-\sqrt{2\Phi_F})$, where $$\gamma=\frac{1}{C_{ox}}\sqrt{2q\in N_A}\text{, and } C_{ox}=\frac{\in_{ox}}{t_{ox}}$$

For simplicity, we assume all transistor widths are the same, therefore, $$\Delta V \geq \sqrt{\frac{2IL_2}{kW}} + \gamma\left(\sqrt{2\Phi_F + V_{ds1}} - \sqrt{2\Phi_F}\right) \quad (2)$$

From Eq. 1, $V_{ds1} \geq \sqrt{\frac{2IL_1}{kW}}$ (3)

Now from composite transistor $M_{comp}$ and $M_6$, ΔV can also be written as, $$\Delta V = V_{gscomp} - V_{gs4} \quad (4)$$

$$= \sqrt{\frac{2IL_{comp}}{kW}} + V_{Tcomp} - \left(\sqrt{\frac{2IL_4}{kW}} + V_{T4}\right)$$

$$= \sqrt{\frac{2I}{kW}}\left(\sqrt{L_{comp}} - \sqrt{L_4}\right) - (V_{T4} - V_{Tcomp})$$

$$= \sqrt{\frac{2I}{kW}}\left(\sqrt{L_{comp}} - \sqrt{L_4}\right) - \gamma\left(\sqrt{2\Phi_F + \Delta V} - \sqrt{2\Phi_F}\right) \geq$$

$$\sqrt{\frac{2IL_2}{kW}} + \gamma\left(\sqrt{2\Phi_F + V_{ds1}} - \sqrt{2\Phi_F}\right),$$

where Eq. (2) has been used. →

$$\sqrt{L_{comp}} - \sqrt{L_4} \geq \sqrt{L_2} + \sqrt{\frac{kW}{2I}}\,\gamma\left(\sqrt{2\Phi_F + V_{ds1}} + \sqrt{2\Phi_F + \Delta V} - 2\sqrt{2\Phi_F}\right) \text{ i.e.,}$$

$$\sqrt{L_3 + L_4} - \sqrt{L_4} \geq \sqrt{L_2} + \sqrt{\frac{kW}{2I}}\,\gamma\left(\sqrt{2\Phi_F + V_{ds1}} + \sqrt{2\Phi_F + \Delta V} - 2\sqrt{2\Phi_F}\right)$$

When body effect can be neglected, Eq. (4) reduces to $$\sqrt{L_3+30L_4}-\sqrt{L_4} \geqq \sqrt{L_2} \quad (5)$$

Eqs. (4) and (5) are the working formulas for determining the sizes of transistors if the widths of the transistors are the same. Somewhat more complicated formulas can be derived using the same principles.

Definitions of Symbols:

$V_{T1}$=threshold voltage of transistor $M_1$ $\Phi_F$=Fermi level $C_{ox}$=gate oxide capacitance per unit area $t_{ox}$=gate oxide thickness $k=\mu C_{ox}$ $\mu$=mobility of carriers in the channel $N_A$=doping density of the p-type substrate $\epsilon_{OX}$=permittivity of silicon oxide In one embodiment, the relation of $L_3$ and $L_4$ can be determined as follows:

$$\sqrt{L_3+30L_4}-\sqrt{L_4} \geqq \sqrt{L_2}$$

Where all transistor widths are assumed to be the same and body effect can be neglected. To have a wide swing, one would like to use minimum channel length for $L_2$. Now let $$L_4 = \chi L_2 \quad (A)$$

Where $\chi \geqq 1$.

Eq. (5) becomes $$\sqrt{L_3+30\chi L_2}-\sqrt{\chi L_2} \geqq \sqrt{L_2}$$

$$\sqrt{L_3+\chi L_2} \geqq (\sqrt{\chi}+1)\sqrt{L_2}$$

$$L_3+\chi L_2 \geqq (\sqrt{\chi}1)^2 L_2$$

Therefore, $$L_3 \geqq (2\sqrt{\chi}+1)\,L_2 \quad (B)$$

In terms of $L_4$, $$L_3 \geq \frac{2\sqrt{\chi}+1}{\chi} L_4 \quad (C)$$

For $\chi$=1, $L_4=L_2$, and $L_3=3L_4$

Instead of transistors $M_3$ and $M_4$ FIG. 3, a simple resistor could be connected between node 30 (the gates of transistors $M_2$ and $M_6$) and node 32 (the gates of transistors $M_1$ and $M_5$) However, such an arrangement would not maintain the same bias point over varying seed currents. Alternately, only transistor $M_3$ might be included, eliminating transistor $M_4$. Again, however, this circuit will be sensitive to variations in the seed current.

Figure 4:
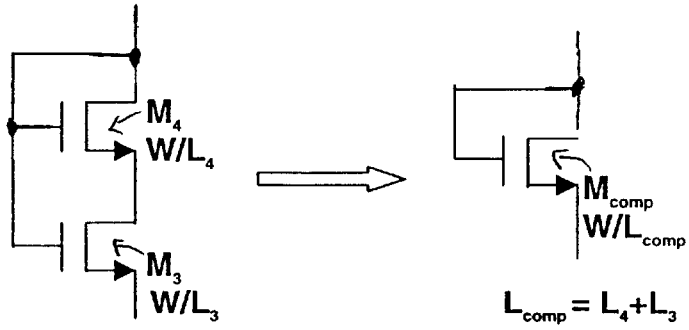
FIG. 4 is a circuit diagram illustrating the theoretical composite transistor formed by the two biasing transistors of FIG. 3.

FIG. 4 illustrates the composite transistor $M_{comp}$ which is formed from transistors $M_3$ and $M_4$. Such a transistor would have a composite length of $L_{comp}=L_{4\ +L3}$. The combined transistor conducts the desired current to be fed through one leg of the current mirror, and at the same time is actually formed of two transistors with the ratio of the lengths providing a bias point that is relatively insensitive to changes in the seed current. In particular, as described above, the length of transistor $M_3$ is greater than that of transistor $M_4$, preferably approximately 3 times greater in one embodiment.

Figure 5:
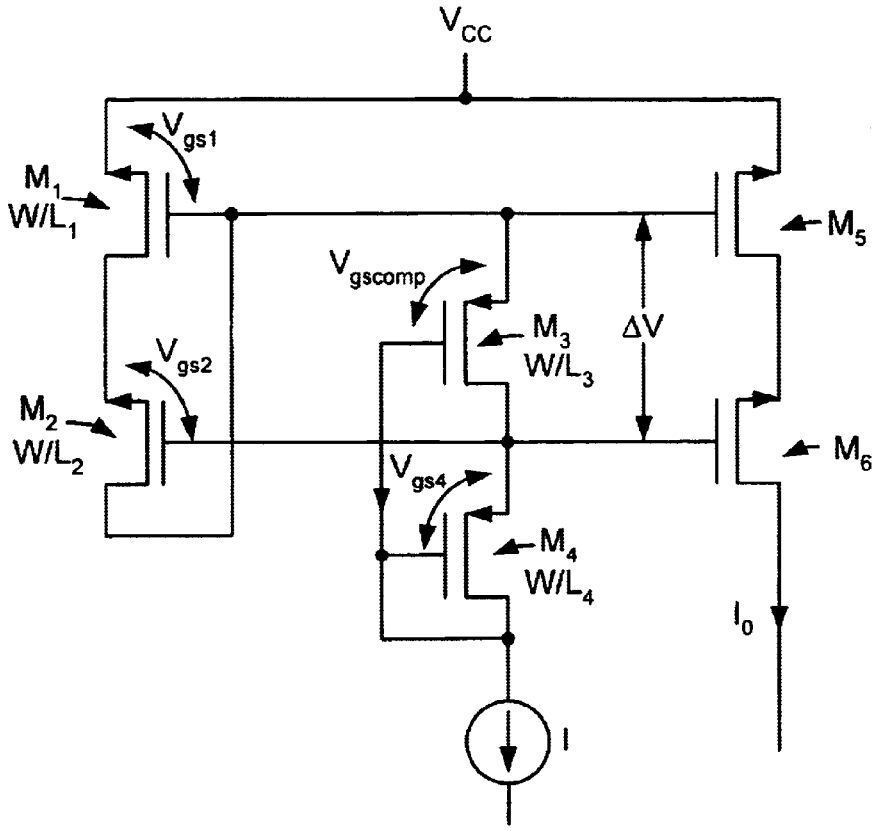
FIG. 5 is a circuit diagram of a second embodiment of the present invention using PFET transistors.
Figure 6:
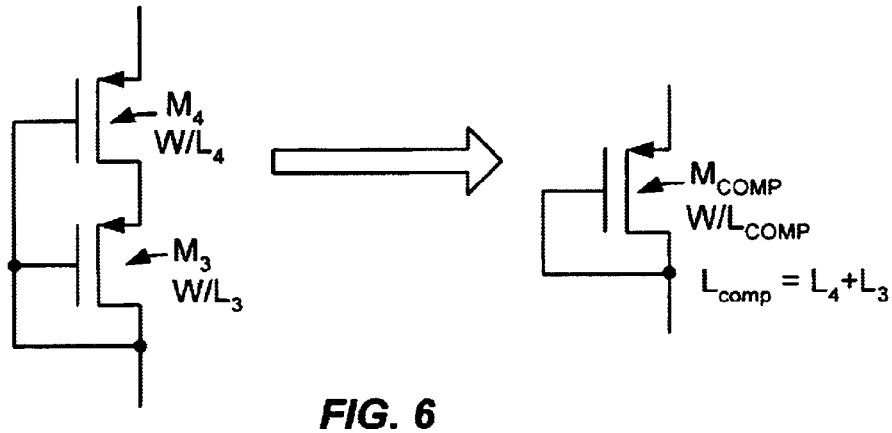
FIG. 6 is a diagram illustrating the theoretical composite transistor formed by the combination of the two biasing transistors of FIG. 5.

FIG. 5 illustrates the corresponding circuit to FIG. 3, implemented with PFET transistors. FIG. 6 illustrates the corresponding composite transistor of transistors $M_3$ and $M_4$ of FIG. 5, corresponding to the diagram of FIG. 4.

As will be understood by those with skill in the art, the present invention may be embodied in other specific forms without departing from the essential characteristics thereof. For example, different ratios of the lengths of the two biasing transistors could be used, or their widths could be varied rather than their lengths. Alternately, by making $L_3$ greater than $L_2$, transistor $M_5$ is pushed farther into saturation. In the PFET embodiment, by connecting the source to the body, the body effect is eliminated. One example of where the present invention could be used, and where it would be desirable to vary the seed current, is in a digital to analog converter (DAC). Accordingly, the foregoing description is intended to be illustrative, but not limiting, of the scope of the invention, which is set forth in the following claims.

What is claimed is:

1. A current mirror circuit comprising:

fifth and sixth transistors coupled in series as an output leg of the current mirror;

first and second transistors coupled in series as a second leg of said current mirror, a gate of said first transistor being connected to a gate of said fifth transistor, and a gate of said second transistor being connected to a gate of said sixth transistor;

a current source; and a transistor biasing circuit coupled between said current source and said first transistor, said transistor biasing circuit providing current mirror current from said current source to said second transistor, and said transistor biasing circuit biasing said gates of said second and sixth transistors;

said transistor biasing circuit comprising third and fourth transistors coupled in series, with a connection between said third and fourth transistors being connected to the gates of said second and sixth transistors, wherein said third transistor is larger than said fourth transistor.

2. The current mirror circuit of claim 1 wherein the widths of said third and fourth transistors are substantially equal, and the length of said third transistor is larger than the length of said fourth transistor.

3. The current mirror of claim 1 wherein said transistors are NFET transistors.

4. The current mirror of claim 1 wherein said transistors are PFET transistors.

5. The current mirror of claim 1 wherein said third transistor has a drain connected to the gates of said second and sixth transistors, a source connected to the gates of said first and fifth transistors, and a gate connected to said current source; and said fourth transistor has a gate and drain connected to said current source, and a source, connected to said drain of said third transistor.

* * * * *